US007736716B2

(12) United States Patent
Hensler et al.

(10) Patent No.: US 7,736,716 B2
(45) **Date of Patent: *Jun. 15, 2010**

(54) TEXTILE PRODUCTS HAVING FLAME RETARDANT PROPERTIES AND METHODS OF MANUFACTURE

(75) Inventors: Connie D. Hensler, Kennesaw, GA (US); Raymond A. Berard, Portsmouth, RI (US)

(73) Assignee: Interface, Inc., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/272,041

(22) Filed: Nov. 17, 2008

(65) Prior Publication Data

US 2009/0075017 A1 Mar. 19, 2009

Related U.S. Application Data

(63) Continuation of application No. 11/348,622, filed on Jan. 20, 2006, now Pat. No. 7,455,898, which is a continuation of application No. 10/294,367, filed on Nov. 14, 2002, now Pat. No. 7,011,724.

(60) Provisional application No. 60/334,797, filed on Nov. 15, 2001.

(51) Int. Cl.
*B32B 33/00* (2006.01)
*D05C 17/02* (2006.01)

(52) U.S. Cl. ..... 428/95; 428/97

(58) Field of Classification Search ..... 428/95, 428/97, 920, 921

See application file for complete search history.

(56) References Cited

U.S. PATENT DOCUMENTS 3,041,707 A 7/1962 Perri
3,719,547 A 3/1973 Black et al.
3,762,942 A 10/1973 Putnam et al.
3,819,462 A 6/1974 Starr et al.
3,825,464 A 7/1974 Crowley
3,859,151 A 1/1975 Vincent et al.

(Continued)

FOREIGN PATENT DOCUMENTS

GB 2014204 A 8/1979

(Continued)

OTHER PUBLICATIONS

International Search Report for PCT/US02/36393 mailed Apr. 9, 2003.

(Continued)

*Primary Examiner*—Cheryl Juska
(74) *Attorney, Agent, or Firm*—Kilpatrick Stockton LLP; John S. Pratt; Kristin M. Crall

(57) ABSTRACT

A textile product with enhanced flame and/or smoke retardant properties and a method of forming the same is disclosed. The textile product is comprised of a textile material having a primary layer or backing with intumescent particles coated, sprayed, sprinkled, or otherwise applied to the upper surface thereof. Additionally or alternatively, the particles may be incorporated into the tufting primary or backing. The intumescent particles may also be complexed with additional agents, such as antimicrobial agents, softening agents, pliability agent, stain resistant agents, waterproofing agents, static resistance agents and combinations thereof.

11 Claims, 1 Drawing Sheet

U.S. PATENT DOCUMENTS

| | | | |
|---|---|---|---|
| 3,861,992 | A | 1/1975 | DeNobriga et al. |
| 3,873,477 | A | 3/1975 | Beck et al. |
| 3,955,987 | A | 5/1976 | Schaar et al. |
| 4,012,546 | A | 3/1977 | Schwartz et al. |
| 4,053,668 | A | 10/1977 | Kimmel et al. |
| 4,061,810 | A | 12/1977 | Minhas et al. |
| 4,173,671 | A | 11/1979 | Minhas et al. |
| 4,194,037 | A | 3/1980 | Stoller |
| 4,218,502 | A | 8/1980 | Graham et al. |
| 4,234,639 | A | 11/1980 | Graham |
| 4,372,997 | A | 2/1983 | Fritze et al. |
| 4,404,297 | A | 9/1983 | Fishler et al. |
| 4,504,546 | A | 3/1985 | Sallay |
| 4,514,524 | A | 4/1985 | Fesman |
| 4,539,045 | A | 9/1985 | Wagner |
| 4,583,344 | A | 4/1986 | Butler |
| 4,610,905 | A | 9/1986 | von Blucher et al. |
| 4,689,256 | A | 8/1987 | Slosberg et al. |
| 4,824,709 | A | 4/1989 | Tschirch |
| 4,879,320 | A | 11/1989 | Hastings |
| 5,356,568 | A | 10/1994 | Levine |
| RE34,951 | E | 5/1995 | Slosberg et al. |
| 5,425,901 | A | 6/1995 | von Bonin et al. |
| 5,723,515 | A | 3/1998 | Gottfried |
| 6,114,421 | A | 9/2000 | Malcangi |
| 6,130,267 | A | 10/2000 | Dueber et al. |
| 6,163,963 | A | 12/2000 | Huang |
| 6,242,502 | B1 | 6/2001 | Brzoskowski et al. |
| 6,463,963 | B1 | 10/2002 | Moody et al. |
| 6,718,100 | B2 | 4/2004 | Morris |
| 7,011,724 | B2 | 3/2006 | Hensler et al. |
| 2004/0121114 | A1 | 6/2004 | Piana et al. |
| 2006/0121238 | A1 | 6/2006 | Hensler et al. |

FOREIGN PATENT DOCUMENTS

| | | | |
|---|---|---|---|
| GB | 2120972 | A | 12/1983 |
| GB | 2179067 | A | 2/1987 |
| JP | 59-047468 | | 3/1984 |
| JP | 07018554 | A | 1/1995 |

OTHER PUBLICATIONS

Non-final Office Action issued Sep. 10, 2004 in U.S. Appl. No. 10/294,367.

Response to Non-final Office Action filed Jan. 12, 2005 in U.S. Appl. No. 10/294,367.

Final Rejection issued Apr. 11, 2005 in U.S. Appl. No. 10/294,367.

Response to Final Rejection filed Jun. 13, 2005 in U.S. Appl. No. 10/294,367.

Advisory Action mailed Jun. 21, 2005 in U.S. Appl. No. 10/294,367.

Supplemental Amendment—After Final filed Sep. 12, 2005 in U.S. Appl. No. 10/294,367.

Non-Final Office Action issued Oct. 2, 2007 in U.S. Appl. No. 11/348,622.

Response to Non-final Office Action filed Feb. 1, 2008 in U.S. Appl. No. 11/348,622.

Final Office Action issued May 13, 2008 in U.S. Appl. No. 11/348,622.

Response to Final Office Action filed Jul. 10, 2008 in U.S. Appl. No. 11/348,622.

TEXTILE PRODUCTS HAVING FLAME RETARDANT PROPERTIES AND METHODS OF MANUFACTURE

This application is a continuation of application Ser. No. 11/348,622 filed on Jan. 20, 2006, which is a continuation of application Ser. No. 10/294,367 filed on Nov. 14, 2002, now issued as U.S. Patent No. 7,011,724 on Mar. 14, 2006, which claims priority to U.S. Provisional Application No. 60/334,797 entitled "Textile Products Having Flame Retardant Properties and Methods of Manufacture," filed Nov. 15, 2001, the entire contents of each of which are hereby incorporated by reference.

BACKGROUND OF THE INVENTION

1. Field of the Invention

This invention relates to a textile product having flame retardant properties provided by intumescent particles coated on the upper surface of a tufting primary backing that provide enhanced flame and/or smoke retardant properties to the textile product. The invention also relates to methods of manufacturing such a textile product.

2. Description of the Related Art

Many commercial textile products are required by law to have smoke suppressant and flame retardant properties in order to help prevent smoke generation and flame spread through the textile products in the event of a fire. Typically, most carpet structures have nylon fibers bonded, tufted, or otherwise joined to a primary backing layer, collectively referred to as a face cloth. The face cloth is then bonded to a back coating layer, commonly made of polyvinylchloride (PVC) or PVC resin, which is quite flammable. Although nylon fibers do not support flames or combustion well, heat from a fire can heat or melt the nylon fibers, which in turn can ignite the PVC, providing a sustained flame source and causing the nylon fibers to burn and emit noxious gases.

Thus, in order to meet the flame and smoke standards, it is fairly common for textile products to be comprised of fibers having flame retardant or smoke suppressant properties. See generally U.S. Pat. No. 4,012,546 to Schwartz et al., which discloses a carpet containing flame retardant fibers, the disclosure of which is hereby incorporated by reference. Alternatively, many textile products consist of at least two distinct components where a textile material is used in conjunction with various additional backing layers or blocking sheets that impart smoke suppressant and flame retardant properties to a given textile product. For instance, much transportation upholstery material is used in conjunction with separate fire blocking sheet layers.

As a further example, many carpets include secondary or tertiary backing layers that have smoke suppressant and flame retardant properties. For instance, some carpets incorporate polybrominated biphenyl oxides, such as decabromobiphenyl oxide ("decabrome"), or antimony oxide in these additional backing layers. However, decabrome is very expensive and antimony oxide may pose toxicity problems. The practice of including fire block sheets and separate backing layers to increase smoke suppression and flame retardancy is expensive and is often difficult to incorporate in the manufacturing process of textile products.

Another attempt to provide textile products with flame retardant and smoke suppressant properties is described by U.S. Pat. No. 4,824,709, to Tschirch, the disclosure of which is hereby incorporated by reference. This patent describes incorporating intumescent particles into a backcoating of a textile product. This practice, however, does not prevent the flame from reaching the backcoating layer, but is merely an attempt to attenuate the effects of a flame once it does reach the backcoating layer. One reason this approach may be considered acceptable is that nylon fibers are not particularly flammable, as noted above.

However, advanced technology has led to the manufacture of carpet fibers from materials other than nylon. In some instances, the new carpet fiber materials provide enhanced properties over nylon fibers, such as increased softness, durability, and so forth. On the other hand, the fibers are often not as flame resistant as nylon fibers. This presents additional difficulties for manufacturers of such products.

The invention of U.S. Pat. No. 4,824,709, to Tschirch would not be effective for use with carpets that have fibers made from a flammable material. Specifically, nylon fibers do not propagate a flame, and as such, there has not been as much need to provide a flame resistant material in close proximity to the fibers. On the other hand, carpets having fibers made of materials that are more flammable than nylon present an increased challenge to providing a flame retarding mechanism. Due to regulations and also due to manufacturers' incentives to provide flame resistant textile products, additional products and methods must be explored for use with less flame resistant carpet fibers. Additionally, it would also be beneficial to provide a carpet product that prevents a flame from ever reaching the flammable backcoating of the carpet.

U.S. Pat. No. 3,859,151 to Vincent, the disclosure of which is incorporated by reference, discusses providing a carpet with a primary backing support for tufted yarn that bears microcapsules containing volatile or volatilizable flame-retarding agent. The agent may also be incorporated into an adhesive applied to the back of the primary backing. In use, the flame-retarding agent is released from the microcapsules under the action of heat to volatize and form a flame-resistant, gaseous atmosphere surrounding each of the yarn tufts. The reference suggests that the use of unencapsulated flame-retardants is not as useful because the volatile, toxic material would evaporate from the adhesive and not be available for protection of the carpet. Microcapsules may contain a gas that expands when heated and escapes to yield free gas, and therefore flame retardance.

SUMMARY OF THE INVENTION

The present invention, however, solves these problems by providing commercially available smoke suppressant-flame retardant intumescent particles coated on or applied to the upper surface of the primary layer or incorporated into the primary layer, or both. Providing the flame retardant barrier above the backcoating, i.e., between the backcoating and the carpet fibers on the upper surface of the primary layer, prevents the flame from ever reaching the more flammable backcoating layer. Accordingly, this invention better prevents PVC backcoating from generating and/or propagating a flame better than the methods currently known. Moreover, the present invention is particularly useful for carpets having fibers that are more flammable than nylon because it provides a flame barrier closer to the fibers and between the fibers and the flammable PVC backcoating. It improves the potential for smoke and flame suppression by preventing a flame from ever reaching the more flammable backcoating layer. Additionally, the use of intumescent particles rather than microcapsules containing volatile or volatilizable flame-retarding agent is advantageous because intumescent particles are less expensive and decompose when heated to form a gas that may put out a flame or may form cellular char for insulation from flame.

The textile product of the present invention includes a textile material that constitutes a primary backing layer and a tufted layer, for instance, a pile carpet or plush material. The primary backing has a layer of intumescent material, such as intumescent particles, coated on the surface to which the textile layer is bonded, tufted, or otherwise joined. Alternatively or additionally, the particles may be incorporated into the primary backing layer.

The flame intumescent material may be a polymer matrix containing inorganic smoke suppressant and/or flame retardant intumescent particles, which are comprised of commercially available mixtures. See e.g., U.S. Pat. Nos. 3,955,987; 4,514,524; 4,824,709; 5,723,515; 6,114,421; 6,242,502, describing various intumescent materials and formulations, the disclosures of each of which are hereby incorporated by reference. See also U.S. Pat. Nos. 4,012,546; 4,173,671; 4,218,502; 4,234,639; 4,372,997; 4,504,546; 4,521,133; 4,539,045; 4,610,905; and 4,618,522; and JOHN W. LYONS, THE CHEMISTRY AND USES OF FLAME RETARDANTS (1970), describing various flame-retardant compositions and products, the disclosures of each of which are hereby incorporated by reference.

When exposed to heat, the intumescent particles of this invention will swell and form an insulating char, thus choking off flames and reducing smoke. This swelling serves as a barrier between the heat source and the backcoating layer, effectively isolating the backcoating layer so that it will not burn.

This invention is particularly beneficial for use in carpets that do not have nylon fibers. Although nylon fibers do not propagate a flame well, new carpet fibers are being developed that are not as flame resistant as nylon. For example, PLA (polylactic acid) fibers are environmentally safe, provide a soft, subtle surface, but have been shown to ignite easily. While nylon fibers usually only melt and form a puddle that subjects the backcoating to an atmosphere that is conducive to burning, PLA fibers will catch fire themselves. This generates a need for a strong flame barrier closer to the fibers themselves, i.e., not in the backcoating.

The intumescent layer may include additional agents to provide enhanced qualities to the textile product, such as antimicrobial agents, softening agents, pliability agent, stain resistant agents, waterproofing agents, static resistance additives to enhance static dissipation, and combinations thereof. Additionally, other flame retardant materials may be incorporated with the intumescent particles or incorporated into other portions of the textile product.

The intumescent particles (or particles mixed with another agent) may be directly applied to the primary layer, or may be incorporated into the fibers that are used to form the primary layer, or both. The material may be mixed with or applied to the primary layer prior to the tufting process, or may be applied simultaneously during the tufting process. It may also be possible to apply the material to the primary layer after it has been tufted.

BRIEF DESCRIPTION OF THE DRAWINGS

Some of the features and advantages of the invention have been identified above. Others will become apparent from the detailed description which follows, and from the accompanying drawings, in which.

In each of the figures, the pattern of intumescent particles is continued beyond the associated carpet structure on the left side of the figure to facilitate visualization of the location of the particles in the carpet structure.

DETAILED DESCRIPTION OF SPECIFIC EMBODIMENTS OF THE INVENTION

This invention will now be described more fully with reference to the drawings, showing preferred embodiments of the invention. However, this invention can be embodied in many different forms and should not be construed as limited to the embodiments set forth.

In general, the textile products of this invention have a flame retardant material, such as intumescent particles coated, screen printed, applied to, dotted onto, incorporated into, or otherwise associated with a primary backing layer. This provides a flame barrier between carpet tufts and the more flammable backcoating.

Figure 1:
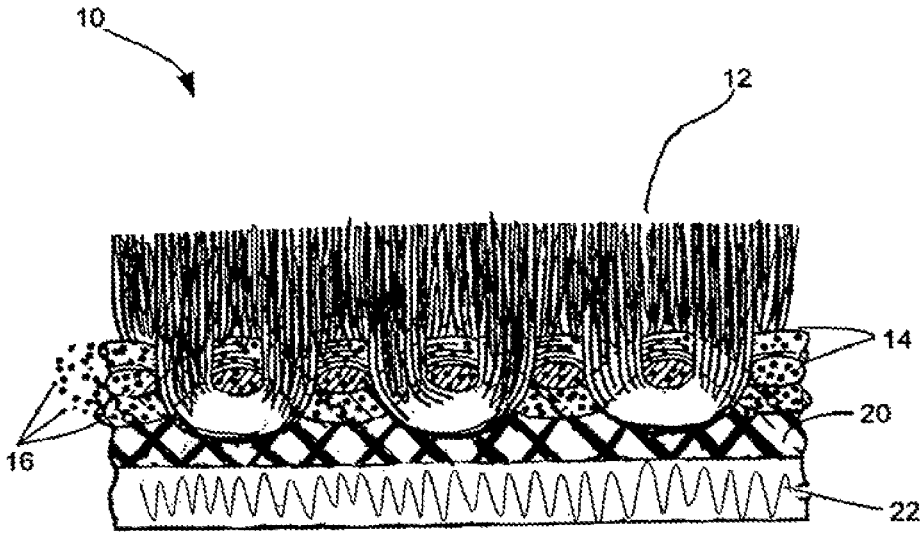
FIG. 1 is an enlarged cross-sectional view of a cut pile carpet in accordance with one embodiment of the present invention.

FIG. 1 illustrates pile carpet 10 having tufted pile yarns 12 looped through and extending upwardly from a primary backing 14. The primary backing 14 may be formed of natural fibers, such as jute, or of synthetic fibers such as polypropylene, polyethylene, or polyester, for example. The primary backing 14 is associated with intumescent particles 16.

Intumescent particles 16 may comprise any commercially available intumescent material, including but not limited to those described by the references incorporated above. For example, hydrated alkali metal silicates and/or an oxy boron compound may be used. Hydrated alkali metal silicates have been previously used as smoke suppressant and/or flame retardant additives in roofing materials, as described in U.S. Pat. Nos. 4,218,502 and 4,521,333, each of which are hereby incorporated by reference. When subjected to the high temperatures present in a fire, water of hydration in the intumescent compound is driven off, causing the composition to puff and expand by some 7 to 30 times its original volume. Sodium silicates are often preferred because of their commercial availability and low cost, but silicates formed from other alkali metals may also be used including, for example, those formed from potassium and lithium. Any intumescent particles that provide the swelling characteristics described above are considered useable with this invention, such as, but not limited to, the intumescent particles disclosed in any incorporated references.

The primary backing layer 14 (also referred to as the primary backing) of FIG. 1 is shown having intumescent particles 16 mixed in the primary backing 14. In this embodiment, the primary backing 14 is made from fibers having intumescent particles 16 incorporated therein. The intumescent particles 16 may be incorporated into the primary backing 14 by mixing them with the fibers forming the primary backing 14 prior to formation. For example, if the primary backing 14 is a non-woven material, the particles 16 are added to a bath, including a binder, as the fibers are formed. The material is pressed and dried, resulting in embedded intumescent particles 16. If the primary backing 14 is spun-bonded, the inclusion of intumescent particles may be achieved by including the particles 16 into the melt. Forming the primary layer out of particles that have intumescent material incorporated therein or pre-coated with the intumescent material may enhance flame barrier properties by strengthening the particles' adherence to the primary layer.

Figure 2:
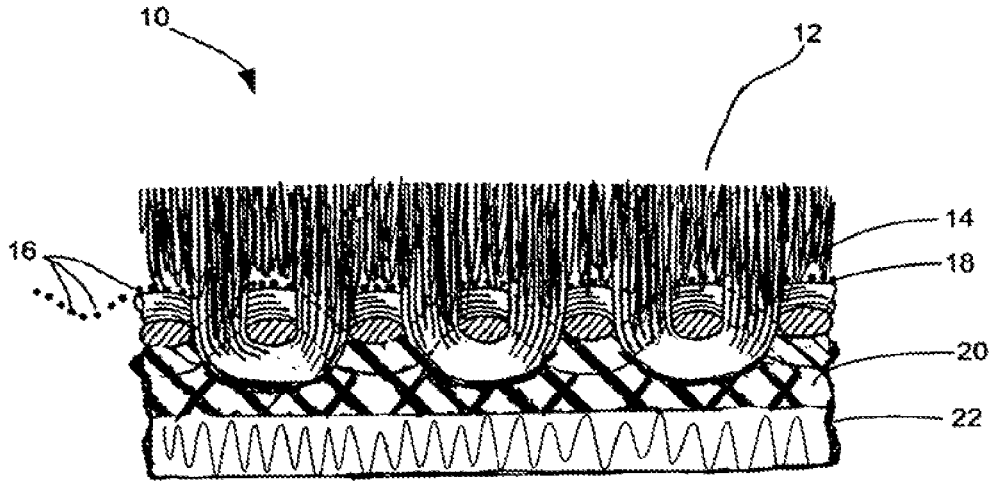
FIG. 2 is an enlarged cross-sectional view of a cut pile carpet in accordance with another embodiment of the present invention.

In an alternate embodiment, shown in FIG. 2, primary backing 14 has intumescent particles 16 coated, screen printed, dotted, sprayed, sprinkled, soaked, layered, or otherwise applied to the upper surface 18 of primary backing 14. In one embodiment, the intumescent material 16 is foamed and applied to the primary backing 14 with a doctor blade. The moisture is then driven off using techniques commonly known in the art. Although intumescent particles 16 are shown somewhat evenly spaced close together in FIG. 2, any spacing or placement of intumescent particles 16 is considered within the scope of this invention. Spreading the particles on the primary material forms a layer directly adjacent to the tufting material, thereby enhancing the smoke suppressant and/or flame retardant properties of the textile material.

Additionally, although not shown, a combination of the embodiments shown in FIGS. 1 and 2 is possible, i.e. a carpet 10 having intumescent particles 16 both incorporated into primary backing 14 as well as layered or applied to upper surface 18 of primary backing 14. For example, the particles 16 may be spread or sprinkled onto primary backing 14 after primary backing 14 has been formed with particles 16 incorporated therein. Additionally or alternatively, particles may be applied to the primary backing 14 as the yarns 12 are tufted into primary backing 14. In this embodiment, the particles 16 form a layer directly adjacent to and substantially in contact with the textile material being treated, thus enhancing the smoke suppressant and/or flame retardant properties directly adjacent to the textile material.

Also shown in FIGS. 1 and 2, a backcoating 20 is provided below intumescent particles 16. Backcoating 20 is an adhesive coating that fixes the pile yarns in place in the primary backing 14. Backcoating 20 may be comprised of any suitable polymer compound, and is typically comprised of a polymer latex, a polymer plastisol compound, polyvinychloride, polypropylene, etc. The backcoating 20 is cured on the textile material by heating or drying or in any other suitable way reacting the backcoating to harden it. An exemplary latex composition includes a polyvinylidene chloride copolymer with at least one acrylic monomer. Standard acrylic monomers include, for example, acrylic acid, methacrylic acid, esters of these acids, or acrylonitrile. Alternatively, the backcoating 20 may comprise conventional thermoplastic polymers which are applied to the carpet by hot melt techniques known in the art.

Finally, a secondary backing 22 may be adhered to the backcoating. The secondary backing 22 may be formed of natural or synthetic fibers, or of a foamed or unfoamed polymer sheet, such as for example, PVC foam or ethylene vinyl acetate foam. As is conventional, the pile yarns 10 may be cut to form cut pile tufts as illustrated in FIG. 1, or may form loops (not illustrated).

Intumescent particles 16 may also be coated on a lower surface of primary backing 14, so long as there is a flame barrier provided between the backcoating 20 and tufts 12 according to the primary concepts of this invention.

In one specific embodiment of this invention, the intumescent particles comprise an acrylic binder, ammonium phosphate, melamine (2,4,6-triamino-1,3,5-trizine) or melamine cyanurate, water, aluminum trihydrate, and melamine-formaldehyde resin. The percentages of these compounds may vary. For example, the particles may comprise about 10-30% acrylic binder (preferably about 20% acrylic binder), about 15-35% ammonium phosphate (preferably about 24% ammonium phosphate), about 5-20% melamine (2,4,6-triamino-1,3,5-trizine) or melamine cyanurate (preferably about 8% melamine (2,4,6-triamino-1,3,5-trizine) or melamine cyanurate), about 10-30% water (preferably about 20% water), about 15-35% aluminum trihydrate (preferably about 23% aluminum trihydrate), and about 1-15% melamine-formaldehyde resin (preferably about 5% melamine-formaldehyde resin). One specific embodiment comprises about 20% acrylic binder, about 20% water, about 24% ammonium polyphosphate, about 8% melamine cyanurate, and about 28% alumina trihydrate.

It may be desirable for the carpet 10 of the present invention to be provided with additional agents imparting various additional characteristics, including but not limited to stain resistance, softness, pliability, waterproofing, antimicrobial action, static resistance additives, and combinations thereof. An exemplary antimicrobial agent for use with this invention is Intersept® brand antimicrobial. Such agents or particles may also be incorporated with the intumescent particles 16 and applied to or incorporated with the primary backing 14.

Figure 3:
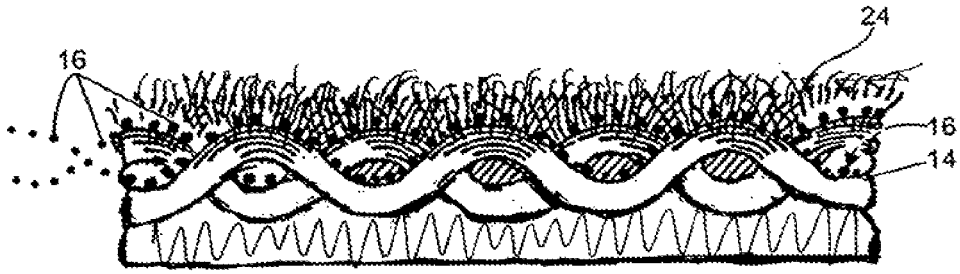
FIG. 3 is an enlarged cross-sectional view of a woven textile product in accordance with the present invention.

FIG. 3 illustrates a woven material 24 having a primary backing 14 similar to that discussed in connection with FIG. 2. The intumescent particles 16 are shown applied to the surface of the backing, but it should be understood that the particles may be incorporated into the primary backing, applied to the surface of the backing, or both. The woven material 24 is comprised of any natural or synthetic fiber yarns and may be brushed so that the material has a softer and more plush feel. This invention may be used with actual velvet plush materials that are commercially manufactured structurally similar to the pile carpet of FIG. 2, with a primary woven backing having plush fibers looped through the backing and extending outwardly from the woven backing. This invention further may also be used with any nonwoven material or any other fabric formed of interengaged yarns that may have various commercial applications including, for example, textile liners like trunk liners, textile materials for wall covering, modular furniture, such as cubical panels, window treatments, and any other textile products.

The particular embodiments of the invention described above are merely illustrative and are not the only embodiments possible. Those skilled in the art can readily identify additional embodiments and features of the invention that are within the scope of the appended claims.

What is claimed is:

1. A flame retardant carpet, comprising:

(a) a primary layer capable of being tufted having an upper surface for receiving a carpet material and a lower surface, the upper surface of the primary layer comprising an applied layer of intumescent material;

(b) carpet fibers tufted on the upper surface of the primary layer; and (c) a backcoating layer, wherein the applied layer of intumescent material on the primary layer provides a flame-retardant barrier above the backcoating layer.

2. The flame retardant carpet of claim 1, wherein the intumescent material is intended to reduce the flammability of the backcoating layer.

3. The flame retardant carpet of claim 1, wherein the intumescent material is coated, screen printed, dotted, sprayed, sprinkled, soaked, layered, applied to the upper surface, or a combination thereof.

4. The flame retardant carpet of claim 1, wherein the intumescent material comprises an acrylic binder, ammonium phosphate, melamine (2,4,6-triamino-1,3,5-trizine), water, aluminum trihydrate, and melamine-formaldehyde resin.

5. The flame retardant carpet of claim 4, wherein the intumescent material comprises:

(a) about 10-30% acrylic binder;

(b) about 15-35% ammonium phosphate;
(c) about 5-20% melamine (2,4,6-triamino-1,3,5-trizine);
(d) about 10-30% water;
(e) about 15-35% aluminum trihydrate; and
(f) about 1-15% melamine-formaldehyde resin.

6. The flame retardant carpet of claim 5, wherein the intumescent material comprises:
(a) about 20% acrylic binder;
(b) about 24% ammonium phosphate;
(c) about 8% melamine (2,4,6-triamino-1,3,5-trizine);
(d) about 20% water;
(e) about 23% aluminum trihydrate; and
(f) about 5% melamine-formaldehyde resin.

7. The flame retardant carpet of claim 1, wherein the intumescent material comprises:
(a) about 20% acrylic binder;
(b) about 20% water;
(c) about 24% ammonium polyphosphate;
(d) about 8% melamine cyanurate; and
(e) about 28% alumina trihydrate.

8. The flame retardant carpet of claim 1, further comprising one or more of an antimicrobial agent, a softening agent, a stain resistant agent, a waterproofing agent, static resistance additives, or any combination thereof.

9. The flame retardant carpet of claim 1, wherein the primary layer further comprises intumescent material incorporated into the primary layer.

10. The flame retardant carpet of claim 1, wherein the applied layer of intumescent material on the upper surface of the primary layer does not stiffen the carpet fibers tufted on the upper surface of the primary layer.

11. A flame retardant carpet, comprising:
(a) a primary layer capable of being tufted having an upper surface for receiving a carpet material and a lower surface, the primary layer comprising intumescent material incorporated into the primary layer;
(b) carpet fibers tufted on the upper surface of the primary layer; and
(c) a backcoating layer, wherein the primary layer with incorporated intumescent material provides a flame-retardant barrier above the backcoating layer.

* * * * *